United States Patent [19]

Warshauer

[11] Patent Number: 4,674,937

[45] Date of Patent: Jun. 23, 1987

[54] MULTI-LEVEL VEHICLE PARKING FACILITY

[76] Inventor: Myron C. Warshauer, 1078 Skokie Ridge, Glencoe, Ill. 60022

[21] Appl. No.: 794,084

[22] Filed: Nov. 1, 1985

[51] Int. Cl.[4] ..... E04H 6/00

[52] U.S. Cl. ..... 414/227

[58] Field of Search ..... 414/227, 228; 52/175, 52/176, 173, 234, 144; 40/906, 612, 565; 340/51, 19 A

[56] References Cited

U.S. PATENT DOCUMENTS

| | | | |
|---|---|---|---|
| 1,481,939 | 1/1924 | Tucker | 52/175 |
| 1,948,077 | 2/1934 | Prescott et al. | 340/19 A |
| 2,435,066 | 1/1948 | Barsh | 340/19 A |
| 2,613,743 | 3/1953 | Hornick | 414/228 |
| 3,382,990 | 5/1968 | Salloum | 414/228 X |
| 3,936,207 | 2/1976 | Sticha | 40/612 X |

FOREIGN PATENT DOCUMENTS

| | | | |
|---|---|---|---|
| 51646 | 4/1977 | Japan | 340/19 A |
| 2089526 | 6/1982 | United Kingdom | 340/19 A |

*Primary Examiner*—Robert J. Spar
*Assistant Examiner*—David A. Bucci
*Attorney, Agent, or Firm*—Ronald A. Sandler; Jerry A. Schulman; Timothy T. Patula

[57] ABSTRACT

An improved multi-level vehicle parking facility including a device for emitting an audible sound, preferably a well known song, on each parking level, with a visual display specifically identifying the audible sound emitted on each such level. Each level has a different audible sound emitted thereon and is identified on the corresponding visual display to facilitate recall of that level to an individual parking a vehicle thereon. In a preferred embodiment, the song is that of a city or other geographical area and the sign identifies the city or area.

16 Claims, 1 Drawing Figure

MULTI-LEVEL VEHICLE PARKING FACILITY

The present invention relates generally to a multi-level vehicle parking facility having coordinated audible signal and visual display means whereby persons parking therein have simple and coordinated means to remind them of the level upon which their vehicles are parked within the parking garage.

BACKGROUND OF THE INVENTION

In today's society, many cities have large multi-leveled, multi-directed self-parking facilities. A person parking a vehicle in such a facility, even after a short time, may find it difficult upon returning to the facility to locate the parked vehicle. Lettering, numbering, or color-coding levels of floors for parking garages, generally do not have enough personal meaning to the individual parking a vehicle as a reminder or to "jog" ones memory as to which level the vehicle is parked.

The present invention provides significant advantages over previous garage identification means consisting only of numbers, and/or letters and/or color combinations, by utilizing multi-faceted coding means capable of providing an easy and a special reminder of the vehicle's level. In its preferred form, the invention utilizes a different, distinctive and unique popular song played on each level of the garage and a visual display of the title, as well as colors and numbers, to help remind the parker of the level where the vehicle is parked. The fact that these well known popular songs have been heard many times and over many years, creates an indelible impression upon the parker and makes it a matter of quick recognition of the tune or song assigned to a respective level where the vehicle was parked.

To additionally facilitate coding, the present invention utilizes songs of or about distinctive cities, which not only are popular but are clearly recognizable to further remind and make the parker familiar with the level in which the vehicle is parked.

Numerous other advantages and features of the invention will become readily apparent from the following detailed description of the preferred embodiment of the invention, from the claims, and from the accompanying drawings, in which like numerals are employed to designate like parts throughout the same.

BRIEF SUMMARY OF THE INVENTION

An improved vehicle parking facility comprising a garage with more than one level, on which for each level there is provided an audible emitting means and corresponding visual display means, to assist persons in recalling upon which level they have parked their vehicles. In a preferred form, a song is used as the audible signal, and the distinctive song may reference a widely recognized city. A listing guide of the songs of each respective level is located at the entrance level of the garage to assist vehicle parkers in remembering which level their vehicle is parked, and also may be located within the facility elevator, if one is provided.

BRIEF DESCRIPTION OF THE DRAWING

A fuller understanding of the foregoing will be had by reference to the accompanying drawing wherein.

DETAILED DESCRIPTION OF THE INVENTION

Figure 1:
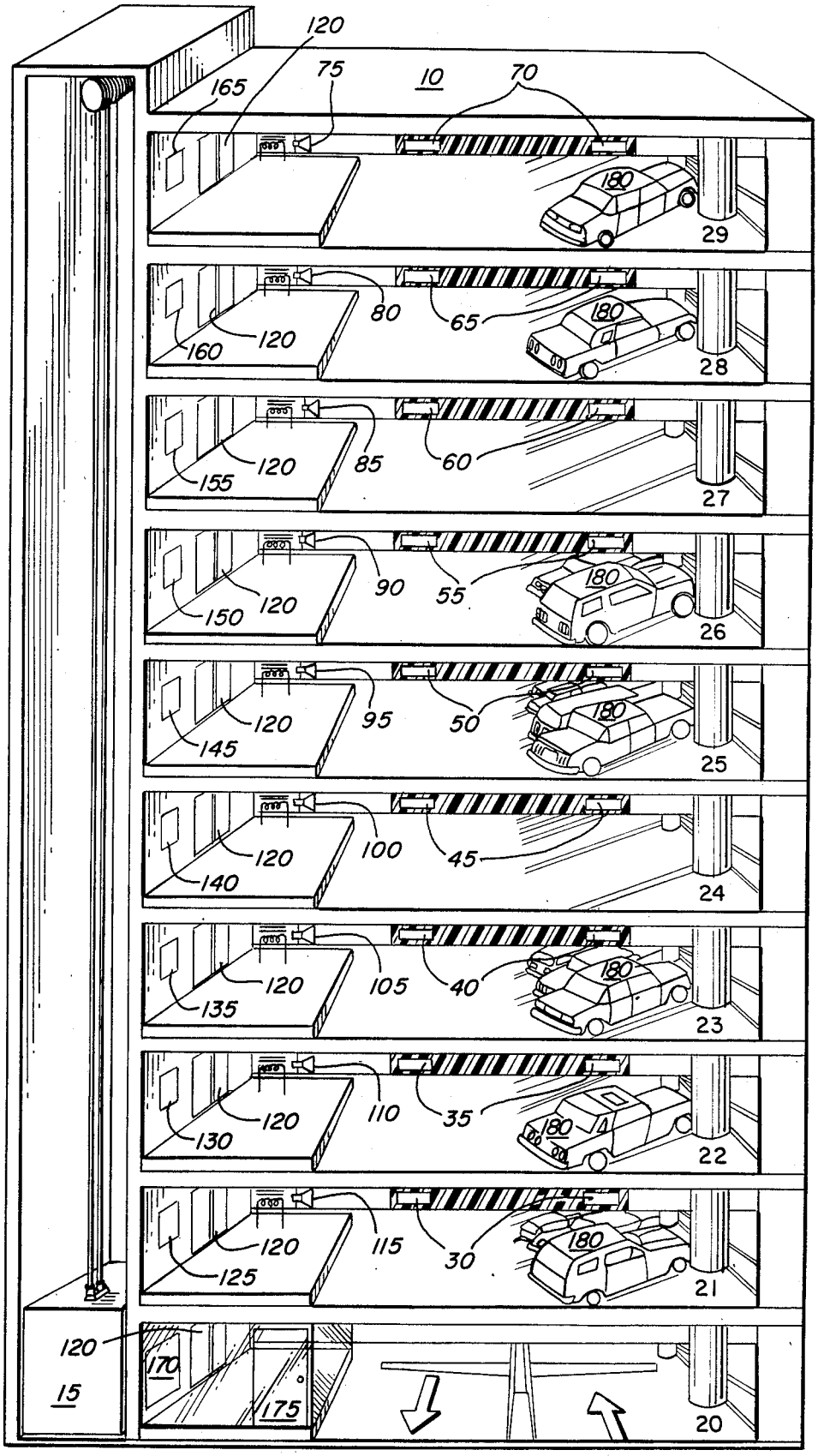
FIG. 1 is a perspective and schematic view of an improved vehicle parking facility constructed in accordance with the preferred embodiment of the present invention.

While this invention is susceptible of embodiment in many different forms, there is shown in the drawing and will herein be described in detail a preferred embodiment of the invention. The invention disclosed herein is equally applicable to many conventional parking identification and control systems besides the embodiment shown and described herein. It should be understood that the present disclosure is to be considered an exemplification of the principles of the invention and is not intended to limit the spirit and scope of the invention and/or claims to the embodiment illustrated.

Referring now to FIG. 1, the numeral 10 indicates generally a multi-level parking garage in which the present invention is provided. A passenger transport device 15, as shown in the preferred embodiment as an elevator or potentially a stairway, transports pedestrians to and from respective facility levels 21–29, on which vehicles are parked and to the main entrance/exit level 20 or ground floor.

Signs 30, 35, 40, 45, 50, 55, 60, 65 and 70 each depicting a color, level number and, in the preferred embodiment the name of a widely recognized geographical location, such as a city, are located at the vehicle drive-through portions of each respective level 21–29 of garage 10. At least one audible sound emitting device, such as loudspeakers 75, 80, 85, 90, 95, 100, 105, 110 and 115, for emitting a popular song or the like referring to the geographical area or city is located at each respective level 21–29 of garage 10, with each such loudspeaker playing a different popular song coordinated with the area or city.

An entrance/exit 120 from a passenger transport device 15 is located on each respective level 21–29 in garage 10. A respective floor level number, color, the geographical or city name, and corresponding popular song title, is indicated on signs 125, 130, 135, 140, 145, 150, 155, 160 and 165 located adjacent the entrance/exit for the passenger transport device 15. An indicating guide 170 is located at the entrance/exit level 20 identifying all numeric levels, respective colors, city names and corresponding popular songs of each the respective levels. A doorway 175 is provided for entrance and exit on foot to and from the garage 10.

The operation of the present invention is simply and effectively described as follows. Vehicles generally identified by the numeral 180, enter the parking garage 10 at entrance/exit level 20 and park in open spaces on one of the respective levels 21–29. As the vehicle parker drives through respective levels 21–29, he or she passes one or more signs 30, 35, 40, 45, 50, 55, 60, 65, and 70 indicating a color, numerical level and a city name. After the vehicle 180 is parked on a particular level, the vehicle parker walks on foot to an exit 120 to enter passenger transport device 15. While waiting for the passenger transport device 15 to arrive at that level, the vehicle parker, in addition to observing the signs, also hears the popular song referencing the city that corresponds to the level on which the vehicle has just been parked, via one of the sound emitting devices 75, 80, 85, 90, 95, 100, 105, 110 and 115. Additionally, signs 125, 130, 135, 140, 145, 150, 155, 160, and 165 positioned adjoining the passenger transport entrance/exit 120 signify the color, numerical level, city name and title of the popular song being played, to further remind the parker on which level the vehicle is parked.

The pedestrian is then transported via the passenger transport device 15 to entrance/exit level 20 and exiting through passenger transport exit 120 leaving garage 10 through doorway 175.

Upon returning to the garage 10 the vehicle parker retrieves his vehicle 180, by entering on foot at the entrance/exit level 20 through door 175 and if need be, examines master indicating guide 170 listing the numeric levels, respective colors and titles of the popular songs referring to the corresponding cities. The pedestrian enters the passenger transport device 15 and travels to the level 21–29 where the vehicle 180 is parked, aided by the recognition of the color, the numerical level, and the song referring to the city. Upon entering that level, the pedestrian should immediately recognize and be reassured by the popular song emanating from one of their sound emitting devices 75, 80, 85, 90, 95, 100, 105, 110 and 115, that he or she has selected the proper level in which the vehicle 180 is parked. The pedestrian then proceeds to the vehicle 180 and leaves garage 10 by driving through the lower levels and exit through entrance/exit level 20. Examples of city and related songs found satisfactory include: (1) San Francisco; (2) Meet me in St. Louis; and (3) My Kind of Town, Chicago . . . etc.

This improved parking identification means allows individuals to easily recall at which level their vehicle is parked and be reassured upon their return, that they have selected the proper level to retrieve their vehicle. This invention eliminates the need for vehicle parkers to search a large multi-level parking garage for their vehicles if they have forgotten where they have parked their vehicles. The present invention alleviates the immense difficulty in finding a vehicle parked in a large multi-leveled, multi-tiered parking garage by a readily recall invoking means for identifying each level in a parking garage system.

While the foregoing has presented specific embodiments of the present invention it is to be understood that these embodiments have been presented by way of example only. Other combinations, such as but not limited to, school songs and schools, flowers and colors or any combination of sight and audible related signals may also be utilized. It is expected that others will perceive differences which, while bearing from the foregoing, do not depart from the spirit and scope of the invention herein described and claimed.

What is claimed:

1. An improved multi-level vehicle parking facility comprising:

a parking facility with more than one level for parking of vehicles thereon;

means for emitting an audible sound on each level of said facility;

visual display means for identifying the audible sound emitted on each level;

each level of said facility being provided with a different audible sound and corresponding visual display means, thereby to facilitate recall of such level to person's parking their vehicles thereon; and wherein the audible sound is a recognizable melody.

2. The improved vehicle parking facility as recited in claim 1, wherein each level of said parking facility is further identified by a different color and coded indicia, thereby to further assist persons in remembering and recalling at which level a vehicle is parked.

3. The improved vehicle parking facility as recited in claim 2, wherein said coded indicia is a numeral.

4. The improved vehicle parking facility as recited in claim 2, wherein said coded indicia is a letter.

5. The improved vehicle parking facility as recited in claim 2, wherein each of said colors corresponding to a different level of said parking facility is further identified at the entrance level of said parking facility and on each respective level.

6. The improved vehicle parking facility as recited in claim 1, wherein said facility includes at least one pedestrian entrance and exit locations on each level and said sound emitting means is located at at least one of such entrances and exits on each said level.

7. The improved vehicle parking facility as recited in claim 6, further including an elevator for delivering and removing pedestrians from the respective parking levels, and sign means for identifying each level in accordance with the visual display and corresponding audible signal at the main floor entrance to said elevator, wherein each visual means displays the title of said melody thereby to serve as an aid in facilitating recall as to which level a vehicle is parked.

8. The improved vehicle parking facility as recited in claim 7, further including sign means located within said elevator identifying each level in accordance with said visual display and corresponding audible signal thereon.

9. The improved vehicle parking facility as recited in claim 1, wherein each visual means displays the title of said melody, thereby to serve as an aid in facilitating recall as to which level a vehicle is parked.

10. The improved vehicle parking facility as recited in claim 1, wherein each said visual means on each said level is labeled and identified by tne name of a widely recognizable geographical location.

11. The facility set forth in claim 10, wherein each said geographical location comprises the name of a different city.

12. The improved vehicle parking facility as recited in claim 10, wherein the title of the melody includes the name of the city designated on said visual means.

13. An improved multi-level vehicle parking facility comprising:

a parking facility with more than one level for parking of vehicles thereon;

means for emitting an audible sound on each level of said facility;

visual display means for identifying the audible sound so emitted on each level;

each level of said facility being provided with a different audible sound and corresponding visual display means, thereby to facilitate recall of such level to person's parking their vehicles thereon;

elevator means for delivering and removing pedestrians from the respective levels;

sign means for identifying each level in accordance with said visual display and corresponding audible signal thereon located within said elevator means;

said facility includes at least one pedestrian entrance and exit locations on each level and said sound emitting means located at at least one of such entrances and exits on each said level;

sign means for identifying each level in accordance with the visual display and corresponding audible signal located at the ground floor entrance to said facility; and wherein the audible sound is a recognizable melody.

14. The improved vehicle parking facility as recited in claim 13, wherein each visual means displays the title of said melody, thereby to serve as an aid in facilitating recall as to which level a vehicle is parked.

15. The improved vehicle parking facility as recited in claim 13, wherein each said visual means on each said level is labeled and identified by the name of a widely recognizable geographical location.

16. The improved vehicle parking facility as recited in claim 13, wherein the title of the melody includes the name of the city designated on said visual means.

* * * * *